US005897416A

United States Patent [19]

Barrows

[11] Patent Number: 5,897,416

[45] Date of Patent: Apr. 27, 1999

[54] IMAGE BOARD WITH DETACHABLE AND INTERCHANGEABLE ACCESSORIES KIT

[76] Inventor: Barbara S. Barrows, 168 North St., Lexington, Mass. 02173

[21] Appl. No.: 08/985,172

[22] Filed: Dec. 4, 1997

[51] Int. Cl.[6] ..... G09F 1/08; A44C 13/00; A63H 3/08

[52] U.S. Cl. ..... 446/147; 446/73; 446/100; 434/99; 434/395; 434/386; 40/538; 40/800; 63/1.16

[58] Field of Search ..... 446/73, 100, 98, 446/387, 147, 71, 75; 434/95, 99, 100, 260, 407, 399, 400, 395, 396, 386, 371, 364, 361; 40/700, 800, 538; 63/1.16, 33; 235/487

[56] References Cited

U.S. PATENT DOCUMENTS

| | | | |
|---|---|---|---|
| 1,860,909 | 5/1932 | Taylor | 434/361 |
| 3,313,044 | 4/1967 | Glass et al. | 446/98 |
| 3,528,079 | 9/1970 | Birch | 446/98 |
| 3,668,805 | 6/1972 | Coleman | 446/98 |
| 3,718,260 | 2/1973 | Sharp . | |
| 3,799,357 | 3/1974 | Govang | 211/59 |
| 3,808,722 | 5/1974 | Byers et al. | 40/152 |
| 4,420,084 | 12/1983 | Whelan | 206/566 |
| 4,459,772 | 7/1984 | Kanzelberger | 40/152.1 |
| 4,905,821 | 3/1990 | Corbett | 206/45.24 |
| 5,738,559 | 4/1998 | Ostrar | 446/100 |

*Primary Examiner*—Robert A. Hafer
*Assistant Examiner*—Laura Fossum

[57] ABSTRACT

A new image board with detachable and interchangeable accessories kit for allowing a user to create an imaginative, novel, three-dimensional work of art. The inventive device includes a card member with an image displayed on an image surface and a plurality of circular perforation sets extending through the card member such that the tearing out of a circular perforation set forms an accessory aperture through the card member. A plurality of accessory members for mounting to the card member image surface are provided. Each accessory member has a mounting portion for extending through an accessory aperture for mounting the accessory member to the card member image surface.

13 Claims, 3 Drawing Sheets

IMAGE BOARD WITH DETACHABLE AND INTERCHANGEABLE ACCESSORIES KIT

BACKGROUND OF THE INVENTION

1. Field of the Invention

The present invention relates to entertainment kits with interchangeable parts and more particularly pertains to a new image board with detachable and interchangeable accessories kit for allowing a user to create an imaginative, novel, three-dimensional work of art.

2. Description of the Prior Art

The use of entertainment kits with interchangeable parts is known in the prior art. More specifically, entertainment kits with interchangeable parts heretofore devised and utilized are known to consist basically of familiar, expected and obvious structural configurations, notwithstanding the myriad of designs encompassed by the crowded prior art which have been developed for the fulfillment of countless objectives and requirements.

Known prior art entertainment kits with interchangeable parts include U.S. Pat. No. 5,178,573; U.S. Pat. No. 4,846,689; U.S. Pat. No. 3,939,604; U.S. Pat. No. 5,328,400; U.S. Pat. No. Des. 361,733; and U.S. Pat. No. 5,094,352.

While these devices fulfill their respective, particular objectives and requirements, the aforementioned patents do not disclose a new image board with detachable and interchangeable accessories kit. The inventive device includes a card member with an image displayed on an image surface and a plurality of concentric perforation sets extending through the card member such that the tearing out of a concentric perforation set forms an accessory aperture through the card member. A plurality of accessory members for mounting to the card member image surface are provided. Each accessory member has a mounting portion for extending through an accessory aperture for mounting the accessory member to the card member image surface.

In these respects, the image board with detachable and interchangeable accessories kit according to the present invention substantially departs from the conventional concepts and designs of the prior art, and in so doing provides an apparatus primarily developed for the purpose of allowing a user to create an imaginative, novel, three-dimensional work of art.

SUMMARY OF THE INVENTION

In view of the foregoing disadvantages inherent in the known types of entertainment kits with interchangeable parts now present in the prior art, the present invention provides a new image board with detachable and interchangeable accessories kit construction wherein the same can be utilized for allowing a user to create an imaginative, novel, three-dimensional work of art.

The general purpose of the present invention, which will be described subsequently in greater detail, is to provide a new image board with detachable and interchangeable accessories kit apparatus and method which has many of the advantages of the entertainment kits with interchangeable parts mentioned heretofore and many novel features that result in a new image board with detachable and interchangeable accessories kit which is not anticipated, rendered obvious, suggested, or even implied by any of the prior art entertainment kits with interchangeable parts, either alone or in any combination thereof.

To attain this, the present invention generally comprises a card member with an image displayed on an image surface and a plurality of concentric perforation sets extending through the card member such that the tearing out of a concentric perforation set forms an accessory aperture through the card member. A plurality of accessory members for mounting to the card member image surface are provided. Each accessory member has a mounting portion for extending through an accessory aperture for mounting the accessory member to the card member image surface.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new image board with detachable and interchangeable accessories kit apparatus and method which has many of the advantages of the entertainment kits with interchangeable parts mentioned heretofore and many novel features that result in a new image board with detachable and interchangeable accessories kit which is not anticipated, rendered obvious, suggested, or even implied by any of the prior art entertainment kits with interchangeable parts, either alone or in any combination thereof.

It is another object of the present invention to provide a new image board with detachable and interchangeable accessories kit which may be easily and efficiently manufactured and marketed.

It is a further object of the present invention to provide a new image board with detachable and interchangeable accessories kit which is of a durable and reliable construction.

An even further object of the present invention is to provide a new image board with detachable and interchangeable accessories kit which is susceptible of a low cost of manufacture with regard to both materials and labor, and which accordingly is then susceptible of low prices of sale to the consuming public, thereby making such image board with detachable and interchangeable accessories kit economically available to the buying public.

Still yet another object of the present invention is to provide a new image board with detachable and interchangeable accessories kit which provides in the apparatuses and methods of the prior art some of the advantages thereof, while simultaneously overcoming some of the disadvantages normally associated therewith.

Still another object of the present invention is to provide a new image board with detachable and interchangeable accessories kit for allowing a user to create an imaginative, novel, three-dimensional work of art.

Yet another object of the present invention is to provide a new image board with detachable and interchangeable accessories kit which includes a card member with an image displayed on an image surface and a plurality of concentric perforation sets extending through the card member such that the tearing out of a concentric perforation set forms an accessory aperture through the card member. A plurality of accessory members for mounting to the card member image surface are provided. Each accessory member has a mounting portion for extending through an accessory aperture for mounting the accessory member to the card member image surface.

Still yet another object of the present invention is to provide a new image board with detachable and interchangeable accessories kit that provides for ever-changing imaginative diversion for children and adults alike.

Even still another object of the present invention is to provide a new image board with detachable and interchangeable accessories kit that provides colored images or allows a user to color in the image as he or she desires.

Even still another object of the present invention is to provide a new image board with detachable and interchangeable accessories kit that may be employed as part of an occupational therapy or rehabilitation program.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
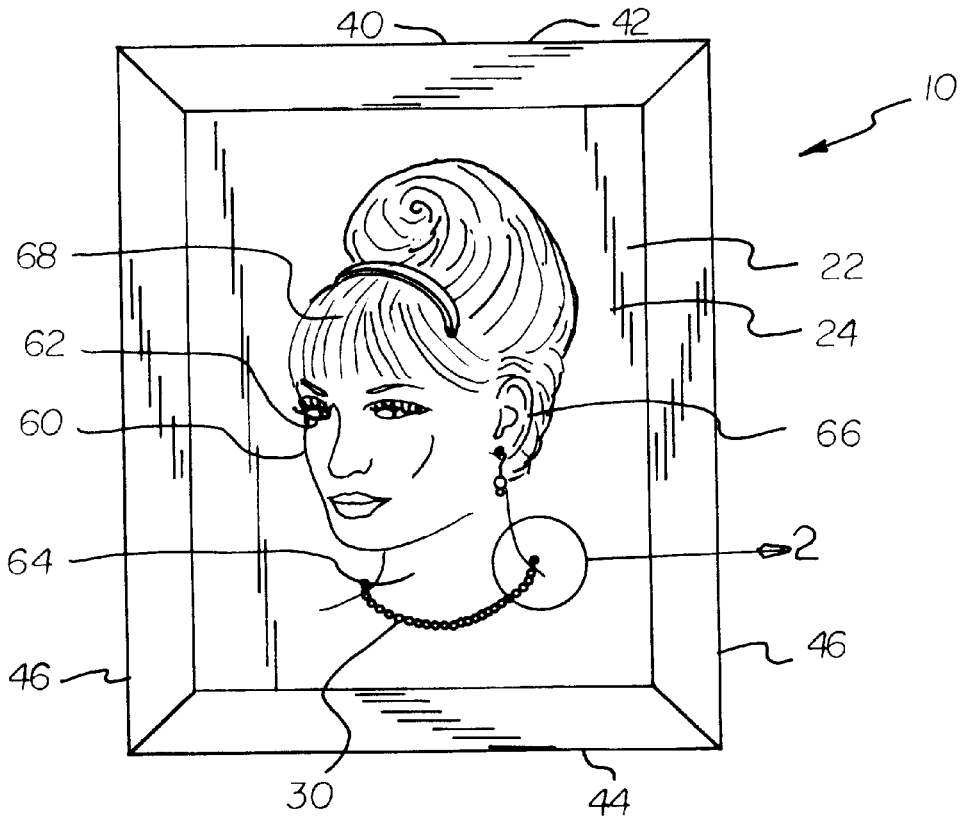
FIG. 1 is a front view of a new image board with detachable and interchangeable accessories kit according to the present invention.
Figure 2:
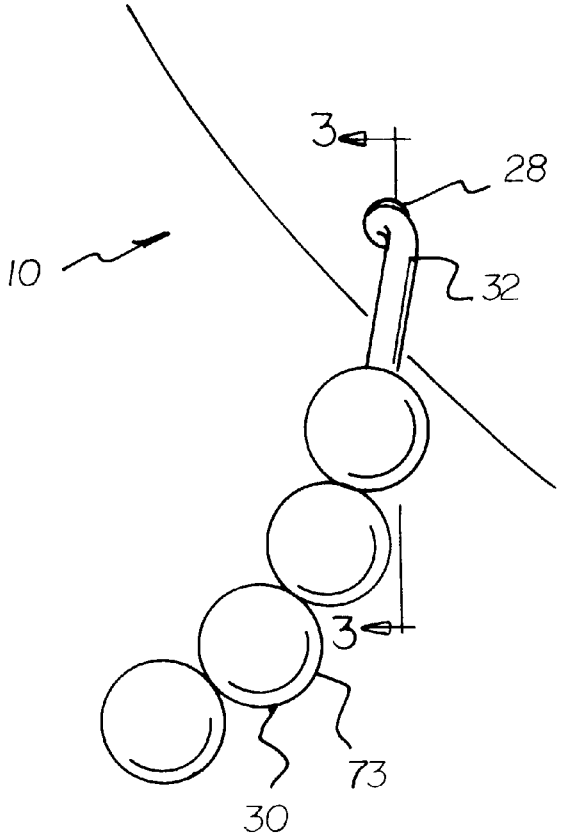
FIG. 2 is a detailed view of the present invention taken from Circle 2 of FIG. 1 showing an accessory mounted to the image surface.
Figure 3:
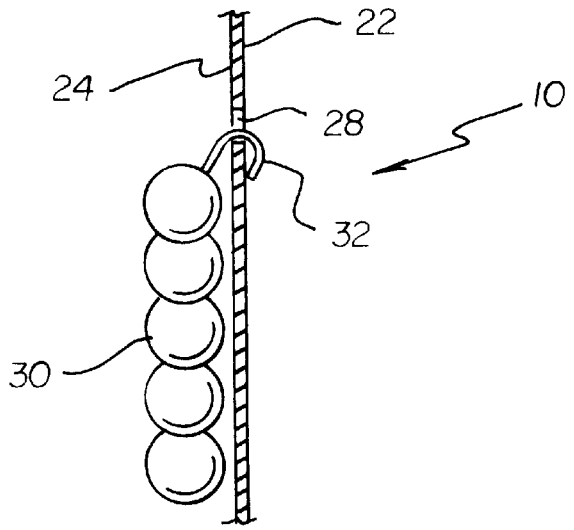
FIG. 3 is a cross-sectional view of the present invention taken from Line 3—3 of FIG. 2.

With reference now to the drawings, and in particular to FIGS. 1 through 5 thereof, a new image board with detachable and interchangeable accessories kit embodying the principles and concepts of the present invention and generally designated by the reference numeral 10 will be described.

As best illustrated in FIGS. 1 through 5, the image board with detachable and interchangeable accessories kit 10 comprises a card member 20, 22 with an image 50, 60 displayed on an image surface 24 and a plurality of circular perforation sets 26 extending through the card member 20, 22 such that the tearing out of a circular perforation set 26 forms an accessory aperture 28 through the card member 20, 22. A plurality of accessory members 30 for mounting to the card member image surface 24 are also provided. Each accessory member 30 has a mounting portion 32 for extending through an accessory aperture 28 so that the accessory member 30 is mounted to the card member image surface 24.

Preferably, as shown in FIG. 1, the image board with detachable and interchangeable accessories kit 10 further includes a rectangular support frame 40 with spaced apart top 42 and bottom 44 sides connected by a pair of spaced apart lateral sides 46 which together define a central aperture 48. The card member 20, 22 is mountable to the support frame 40 such that the card member 20, 22 substantially covers the support frame central aperture 48.

Ideally, a plurality of card members 20, 22 are provided, each having an image surface 24 displaying a different image 50, 60. Each card member 20, 22 is mountable to a support frame 40 such that each card member 20, 22 substantially covers the central aperture 48 of the support frame 40.

Figure 4:
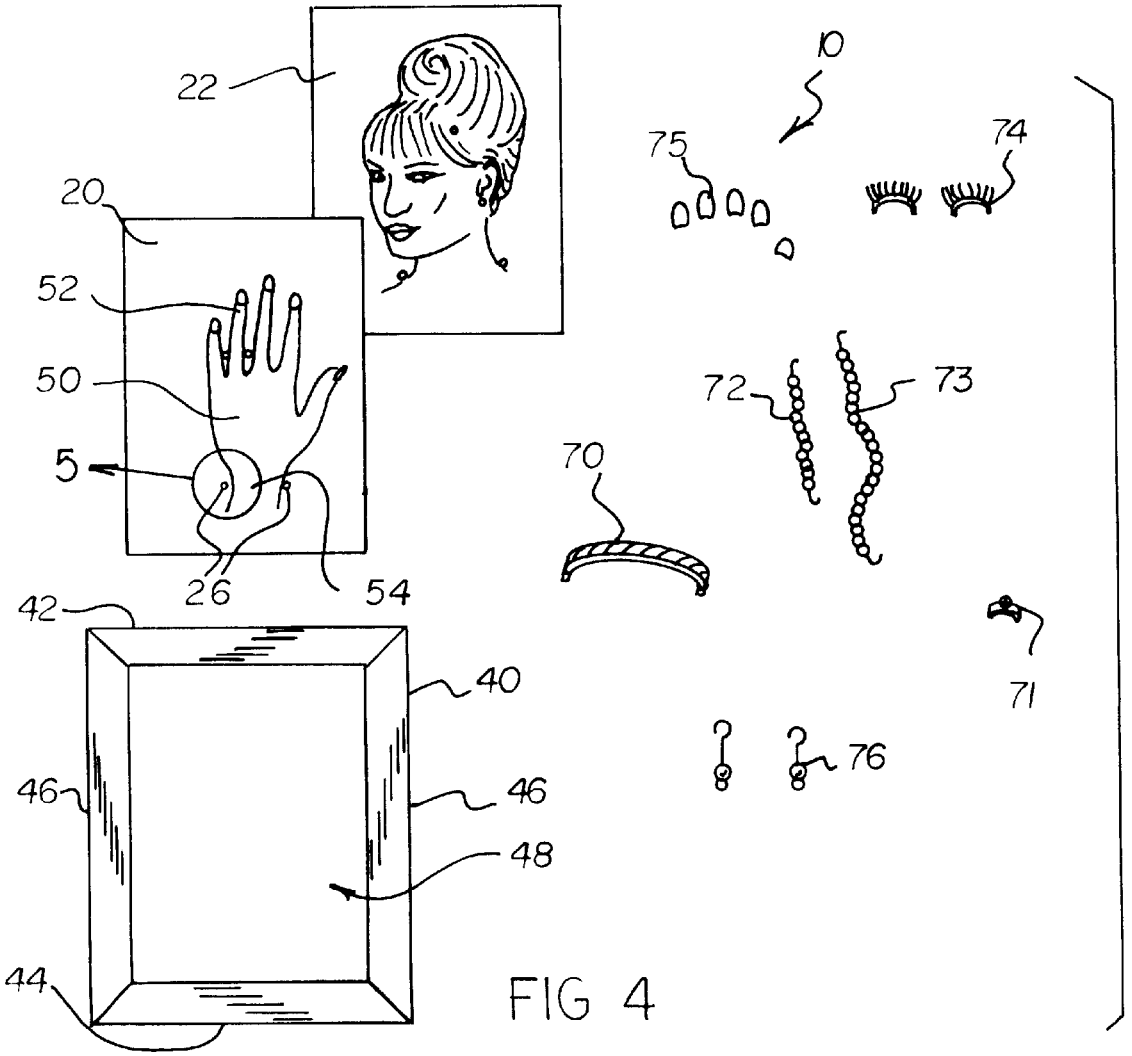
FIG. 4 is a schematic view of an image board with detachable and interchangeable accessories kit.
Figure 5:
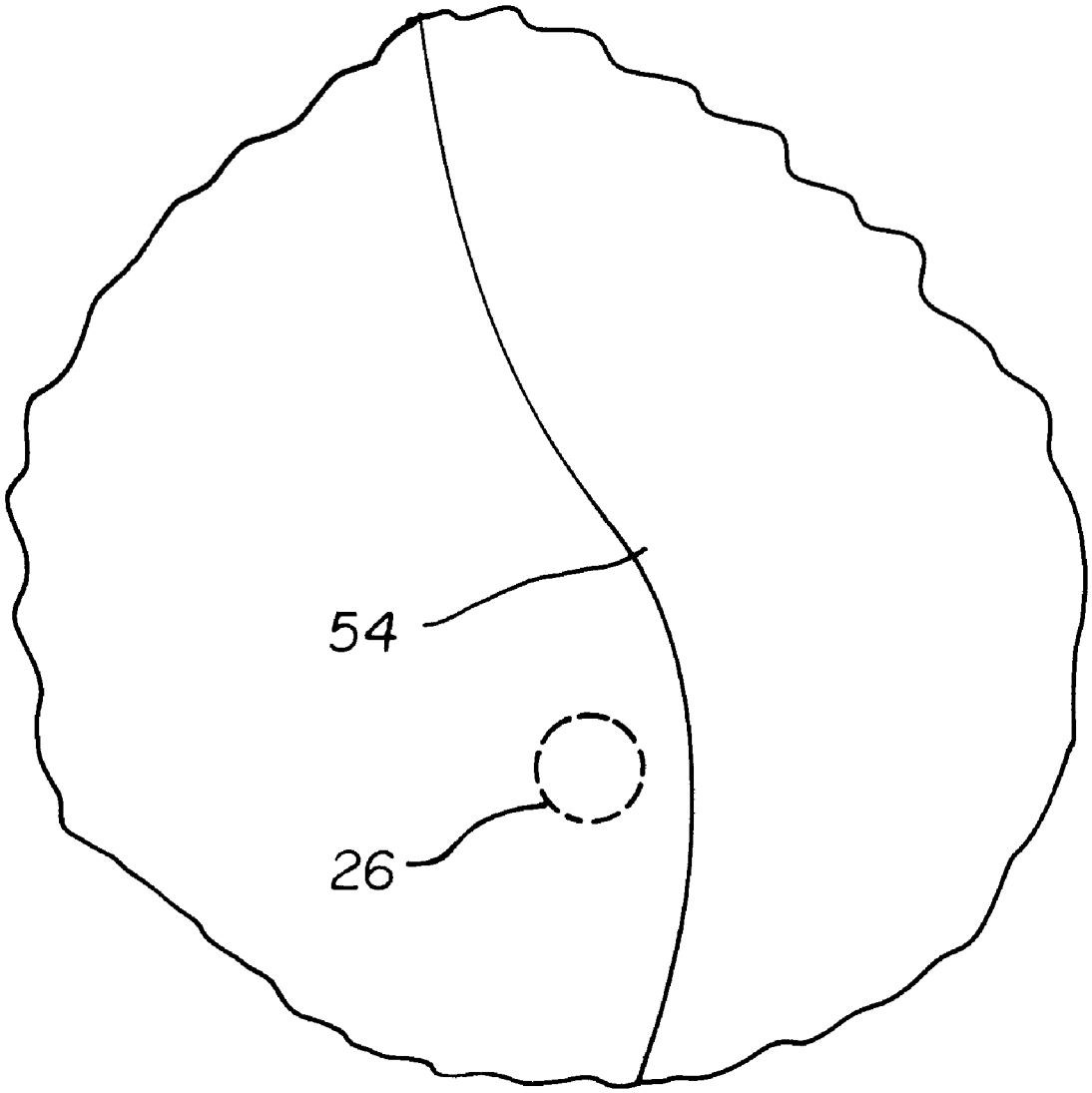
FIG. 5 is a detailed view of a perforation set of the present invention taken from Circle 5 of FIG. 4.

In an exemplary embodiment, as shown in FIG. 4, a first card member 20 has an image 50 of a hand displayed on the first card member image surface 24. The image 50 of the hand includes a plurality of fingers 52 and a wrist 54. A circular perforation set 26 is positioned adjacent a finger 52 of the image 50 of the hand. Another circular perforation set 26 is positioned adjacent the wrist 54 of the image 50 of the hand.

In a second exemplary embodiment, as shown in FIG. 1, a second card member 22 has an image 60 of a human head displayed on the second card member image surface 24. The image 60 of the head includes a pair of eyes 62, a neck 64, an ear 66, and a hair portion 68. A circular perforation set 26 is positioned adjacent an eye 62 of the image 60 of the head. A circular perforation set 26 is positioned adjacent the neck 64 of the image of the head 60. A circular perforation set 26 is positioned adjacent an ear 66 of the image 60 of the head. A circular perforation set 26 is positioned adjacent the hair portion 68 of the image 60 of the head.

It is not intended to limit the possible images to those set forth above, as varying images may be provided on the card member image surfaces of the image board with detachable and interchangeable accessories kit 10. Various images may be provided in color or as images that a user may color in himself or herself.

The plurality of accessory members 30 each have a mounting portion 32 that extends through an accessory aperture 28 for mounting each accessory member 30 to the card member image surface 24. As seen in FIG. 4, an illustrative assortment of accessory members 30, corresponding to the above exemplary image boards, include a barrette accessory member 70 , a ring accessory member 71, a bracelet accessory member 72, a necklace accessory member 73, a pair of eyebrow accessory members 74, a plurality of finger nail accessory members 75, and a pair of earring accessory members 76. However, it is not intended that the accessory members be limited to the above examples, as accessory members may be included in the accessories kit in a variety of designs as well as in assorted combinations. Use of costume jewelry and accessory members created by the user is also contemplated.

In use, a card member 20, 22 with a desired image 50, 60 displayed on the image surface 24 is selected. One or more accessory members 30 for mounting to the image surface 24 are also selected. The perforation sets 26 corresponding to the selected accessory members 30 are torn out to form accessory apertures 28. Unselected perforation sets 26 are left intact so as not to disturb the remaining portions of the image 50, 60. The card member 20, 22 is mounted to the support frame 40. The accessory member 30 is mounted to the image surface 24 by inserting a mounting portion 32 of the accessory member 30 into an accessory aperture 28.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. An image board with detachable and interchangeable accessories kit, comprising:

a card member having an image surface, said card member having a plurality of circular perforation sets being extended therethrough. each of said circular perforation sets being defined by a series of perforations arranged in a circular configuration such that the tearing of each circular perforation set forms an accessory aperture through said card member, said image surface having an image being displayed thereon;

a plurality of accessory members for mounting to said card member image surface, each said accessory member having a mounting portion for extending through a said accessory aperture for mounting each said accessory member to said card member image surfaces said card member having an image of a human head being displayed on said image surface of said card member said image of said head including a pair of eyes, a neck, an ear and a hair portion, wherein a pair of said circular perforation sets being positioned adjacent to opposite sides of said neck of said image of a head for receiving opposite ends of a necklace; and said accessory members having a necklace accessory member, said necklace accessory member comprising a necklace and having a pair of mounting portions being extended from opposite ends thereof, said mounting portions of said necklace accessory member being insertable in said circular perforation sets positioned adjacent said neck of said image of a head to simulate a necklace extending around a neck.

2. The image board of claim 1, further including a rectangular support frame having a spaced apart top and bottom sides connected by a pair of spaced apart lateral sides, said sides defining a central aperture, and said card member being mountable to said support frame such that said card member substantially covers said central aperture of said support frame.

3. The image board of claim 1, wherein there are a plurality of said card members, each said card member having an image surface, each said card member having a plurality of circular perforation sets being extended therethrough, each of said circular perforation sets being defined by a series of perforations arranged in a circular configuration such that the tearing of each circular perforation set forms an accessory aperture through said card member, and each said image surface having an image being displayed thereon.

4. The image board of claim 3, further including a rectangular support frame having a spaced apart top and bottom sides connected by a pair of spaced apart lateral sides, said sides defining a central aperture, and each said card member being mountable to said support frame such that said card member substantially covers said central aperture of said support frame.

5. The image board of claim 3, wherein a second card member of said plurality of card members has an image of a hand being displayed on said second card member image surface.

6. The image board of claim 5, wherein said image of a hand includes a plurality of fingers and a wrist, a said circular perforation set being positioned adjacent a said finger of said image of a hand, and a said circular perforation set being positioned adjacent said wrist of said image of a hand.

7. The image board of claim 1, wherein said image of said human head further includes a pair of a said circular perforation set being positioned adjacent said eye of said image of a human head, a said circular perforation set being positioned adjacent said ear of said image of a human head, and a said circular perforation set being positioned adjacent said hair portion of said image of a human head.

8. The image board of claim 1, wherein said accessory members further include a barrette accessory member, a pair of eyelash accessory members, and a pair of earring accessory members.

9. The image board of claim 1, wherein said accessory members include a barrette accessory member, said barrette accessory member having a generally semicircular shape and a pair of mounting portions being extended from opposite ends thereof, a pair of said circular perforation sets being positioned on opposite sides of said hair portion of said image of a head said mounting portions of said barrette accessory member being insertable in said circular perforation sets positioned adjacent said hair portion of said image of a head.

10. The image board of claim 1, wherein said accessory members include a pair of eyelash accessory members, said eyelash accessory members each having a generally semicircular shape and a pair of mounting portions being extended from opposite ends thereof, a pair of said circular perforation sets being positioned on opposite sides of said neck of said image of each of said eyes of said mounting portions of said eyelash accessory members being insertable in said circular perforation sets positioned adjacent said eyes of said image of a head to simulate eyelashes extending from an eyelid.

11. An image board with detachable and interchangeable accessories kit, comprising:

a card member having an image surface, said card member having a plurality of circular perforation sets being extended therethrough, each of said circular perforation sets being defined by a series of perforations arranged in a circular configuration such that the tearing of each circular perforation set forms an accessory aperture through said card member, said image surface having an image being displayed thereon;

a plurality of accessory members for mounting to said card member image surface, each said accessory member having a mounting portion for extending through a said accessory aperture for mounting each said accessory member to said card member image surface;

wherein said card member has an image of a hand being displayed on said card member image surface, said image of a hand including a plurality of fingers and a wrist, a pair of said circular perforation sets being positioned on opposite sides of a said finger of said image of a hand, a pair of said circular perforation sets being positioned on opposite sides of said wrist of said image of a hand;

said accessory members including a ring accessory member, said ring accessory member comprising half of a ring and having a generally semicircular shape and a pair of mounting portions being extended from opposite ends thereof, said mounting portions of said ring accessory member being insertable in said circular perforation sets positioned adjacent said finger of said image of a hand to simulate a ring being extended around a finger.

12. The image board of claim 11, wherein said accessory members include a bracelet accessory member, said bracelet accessory member comprising a bracelet and having a pair of mounting portions being extended from opposite ends thereof, each of said mounting portions of said bracelet accessory member comprising a generally J-shaped hook, said mounting portions of said bracelet accessory member being insertable in said circular perforation sets positioned adjacent said wrist of said image of a hand to simulate a bracelet extending around a wrist.

13. An image board with detachable and interchangeable accessories kit, comprising:

a rectangular support frame having spaced apart top and bottom sides connected by a pair of spaced apart lateral sides, said sides defining a central aperture;

a plurality of card members each having an image surface, each said card member being mountable to said support frame such that said card member substantially covers said central aperture of said support frame, each said card member having a plurality of circular perforation sets being extended therethrough, each of said circular perforation sets being defined by a series of perforations arranged in a circular configuration such that the tearing of each circular perforation set forms an accessory aperture through said card member, each said image surface having an image being displayed thereon;

wherein a first said card member has an image of a hand being displayed on said first said card member image surface, said image of a hand including a plurality of fingers and a wrist, a pair of said circular perforation sets being positioned adjacent to opposite sides of a said finger of said image of a hand, a pair of said circular perforation sets being positioned adjacent to opposite sides of said wrist of said image of a hand, wherein a second said card member has an image of a human head being displayed on said second said card member image surface, said image of said head including a pair of eyes, a neck, an ear, and a hair portion, a pair of said circular perforation sets being positioned adjacent to opposite sides of each of said eyes of said image of a head, a pair of said circular perforation sets being positioned adjacent to opposite sides of said neck of said image of a head, a said circular perforation set being positioned adjacent said ear of said image of a head, a said circular perforation set being positioned adjacent said hair portion of said image of a head;

a plurality of accessory members for mounting to a said card member image surface, each said accessory member having a mounting portion for extending through a said accessory aperture for mounting each said accessory member to a said card member image surface, said accessory members including a barrette accessory member, a ring accessory member, a bracelet accessory member, a necklace accessory member, a pair of eyelash accessory members, a plurality of finger nail accessory members, and a pair of earring accessory members said barrette accessory member having a generally semicircular shape and a pair of mounting portions being extended from opposite ends thereof, said mounting portions of said barrette accessory member being insertable in said circular perforation sets positioned adjacent said hair portion of said image of a head;

said ring accessory member comprising half of a ring and having a generally semicircular shape and a pair of mounting portions being extended from opposite ends thereof, said mounting portions of said ring accessory member being insertable in said circular perforation sets positioned adjacent said finger of said image of a hand to simulate a ring being extended around a finger;

said bracelet accessory member comprising a bracelet and having a pair of mounting portions being extended from opposite ends thereof, each of said mounting portions of said bracelet accessory member comprising a generally J-shaped hook. said mounting portions of said bracelet accessory member being insertable in said circular perforation sets positioned adjacent said wrist of said image of a hand to simulate a bracelet extending around a wrist;

said necklace accessory member comprising a necklace and having a pair of mounting portions being extended from opposite ends thereof, each of said mounting portions of said necklace accessory member comprising a generally J-shaped hook. said mounting portions of said necklace accessory member being insertable in said circular perforation sets positioned adjacent said neck of said image of a head to simulate a necklace extending around a neck; and said eyelash accessory members each having a generally semicircular shape and a pair of mounting portions being extended from opposite ends thereof, said mounting portions of said eyelash accessory members being insertable in said circular perforation sets positioned adjacent said eyes of said image of a head to simulate eyelashes extending from an eyelid.

* * * * *